United States Patent [19]

Dudzik et al.

[11] Patent Number: 4,547,249

[45] Date of Patent: Oct. 15, 1985

[54] SENSOR FOR LABEL TRANSPORTING EQUIPMENT

[76] Inventors: Joachim Dudzik, Vor dem Klingler 1, 7440, Nürtingen; Winfried Dudzik, Drosselweg 13, 7441, Neckartailfingen, both of Fed. Rep. of Germany

[21] Appl. No.: 593,044

[22] Filed: Mar. 23, 1984

[30] Foreign Application Priority Data

Mar. 24. 1983 [DE] Fed. Rep. of Germany ..... 3310839

[51] Int. Cl.[4] ..... B65C 9/18

[52] U.S. Cl. ..... 156/363; 221/73

[58] Field of Search ..... 156/361–363, 156/542, 584; 221/73; 200/61.13, 61.14, 61.41

[56] References Cited

U.S. PATENT DOCUMENTS

| | | | |
|---|---|---|---|
| 2,817,725 | 12/1957 | Rochfort et al. | 200/153 T |
| 3,133,785 | 5/1964 | Ahlberg et al. | 200/61.41 |
| 3,527,382 | 9/1970 | Knoll | 221/73 |
| 3,655,492 | 4/1972 | Burton | 156/584 X |

*Primary Examiner*—David Simmons

*Attorney, Agent, or Firm*—Erwin S. Teltscher

[57] ABSTRACT

A band carrying a series of labels separated by gaps is transported step by step past a location at which individual labels are removed and automatically applied to boxes, etc. Along the path of the band, at a scanning station, a backing plate is provided on the empty side of the band, while the side with the labels is scanned by a device which consists of a feeler roller eccentrically mounted on an angle lever. As the roller drops into the gap between labels, the lever pivots, carrying along with it a bar whose opposite end normally interrupts the flow of air in an air cell. The rotation frees the air cell causing generation of a signal designed to stop the transport of the band. To allow for the relatively long response time of the cell, the bar is rotatably mounted on the lever and continues its motion due to inertia after the lever itself has stopped and even after it has reversed direction as the roller moves onto the next label. A spring then pushes the bar back to its rest position wherein one end overlaps the lever while the other end blocks the air passage through the cell. This allows airflow in the cell for a sufficiently long time even with high band transport speeds and small gaps between labels.

16 Claims, 3 Drawing Figures

SENSOR FOR LABEL TRANSPORTING EQUIPMENT

CROSS REFERENCE TO RELATED APPLICATIONS AND PUBLICATIONS:

The subject matter of this application is related to that of our copending application entitled "Labeling Apparatus With Improved Label Transport Control", Ser. No. 593,042 filed Mar. 23, 1984.

FIELD OF THE INVENTION

The present invention relates to automatic or semiautomatic devices applying labels to objects such as crates or boxes. In particular, the transport for the band carrying the labels is a step by step transport which must be stopped when the labels are in a particular position relative to a device removing the labels from the band. The present invention is concerned with a device generating a signal stopping the transport when each label is properly positioned.

BACKGROUND OF THE INVENTION

In conventional labeling equipment of the above-described type, a series of labels is carried by the band, with gaps between consecutive labels. Further, control holes are in the band and these control holes are sensed either by an air cell or by a light cell. The fact that such control holes must be provided is in itself a disadvantage. Additionally, the holes may not be properly formed, causing the band transport to malfunction. In addition, the velocity with which the band may be advanced must be kept within predetermined limits, since the time that the holes are within the range of the feeler or sensor must exceed the response time of the scanning apparatus including the cell. This problem exists mainly when air cells are used, since these have a relatively high response time.

SUMMARY OF THE INVENTION

It is an object of the present invention to furnish an improved scanning device which allows high band velocities and, preferably, obviates the need for control holes while still allowing a reliable control of the transport.

According to the present invention, the scanning device consists of a backing or support positioned on the side of the band which does not carry the labels. A feeler is provided which is pressed against the side of the band carrying the labels, so that the feeler position changes either at the edge of a label or when the gap between labels is being sensed. The change in position of the feeler causes a corresponding change in the position of bar linked to the feeler mechanism which, in turn, switches either an air or a light cell from a first to a second state. When the cell is in the second state, the signal stopping the transport is generated. Additionally, a delay member, such as a spring, may be provided to cause the bar to maintain the switch in the second state for a longer time than the time corresponding to the sensing of the gap between labels, so that higher band transport velocities may be used.

According to a preferred embodiment, the feeler is connected to an angle lever which pivots about an axis parallel to the band and perpendicular to its direction of advance. The feeler is connected to one arm of the lever which, in turn, is pushed against the band by means of a spring. The second arm of the lever extends perpendicularly to the first arm and supports one end of a bar whose other end switches the state of the air or light cell. One side of the lever is provided with a stop which carries along the bar when the lever pivots in response to sensing of the gap by feeler. The bar is moved against the force of a weak spring affixed to the lever and continues its motion after the lever has stopped and even after the lever has reversed direction. This increases the time that the cell is in the state generating the signal for stopping the transport. The force of the spring finally causes the bar to be returned to the position abutting the stop.

The novel features which are considered as characteristic of the invention are set forth in particular in the appended claims. The invention itself, however, both as to its construction and its method of operation, together with additional objects and advantages thereof, will be best understood from the following description of specific embodiments when read in conjunction with the accompanying drawing.

FIG. 1 is a top view of labeling apparatus with a mechanical scanning device; and FIGS. 2*a* and *b* show the scanning device in the rest and activated position, respectively.

DESCRIPTION OF THE PREFERRED EMBODIMENT:

Figure 1:
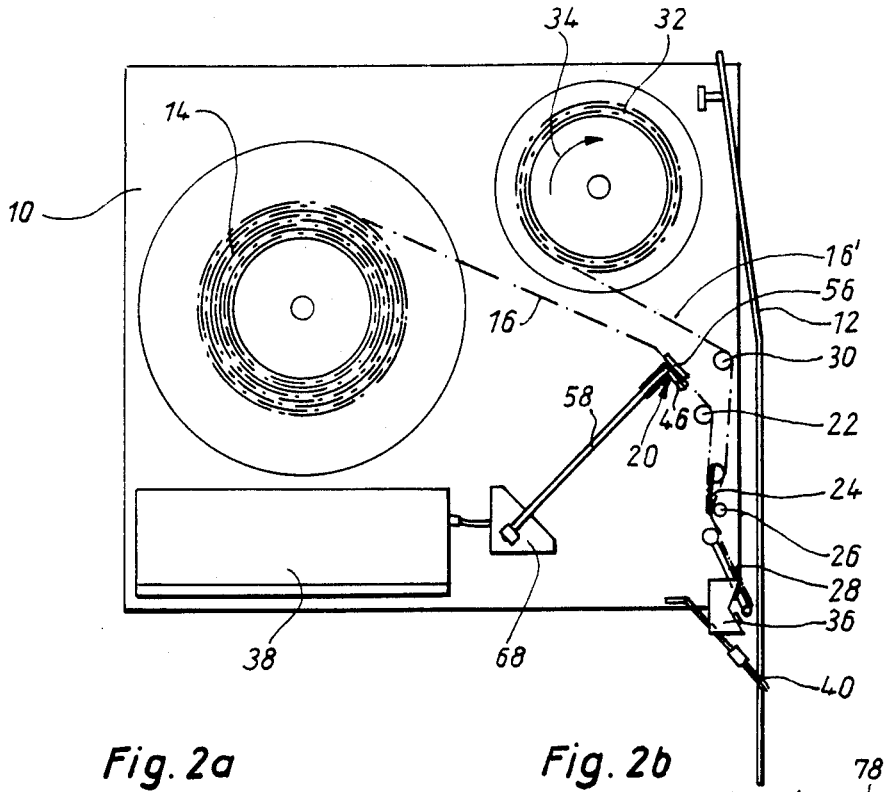

The labeling equipment illustrated in FIG. 1 may be used, for example, for automatically applying self-adhesive labels to block-and-tackle boxes transported past the device on one side of a guide rod 12.

A band 16 is pulled from the supply reel 14 and carries self-adhesive labels at predetermined distances from one another on the side facing downward in FIG. 1. The band is transported past a scanning device 20 and a guide roller 22 to a label removing station. This consists of a sharp edge 24 at which the direction of advance of the band is changed so that the first label 18 is removed from the band and pushed forwards under a roller 26 onto a flap 28, while the empty band 16' is directed towards a take-up reel 32 by means of a second guide roller 30. The take-up reel is driven in a stepwise manner in the direction of arrow 34.

Application of the label to the box and the subsequent step of band transport is initiated by the output signal of an optical scanner 36. Scanner 36 recognizes markings on the box and furnishes information according thereto to a central pneumatic control 38. During labeling, flap 28 with self-adhesive label 18 is pushed against the side of the passing box by means of a pneumatic cylinder 29. The box then passes a brush 40 which causes the label, which is already sticking at its front edge, to be firmly affixed to the wall of the box throughout its length. During, or immediately after this labeling process, the next transport step is initiated by central control 38, causing the next self-adhesive label 18 to arrive at edge 24. Thereafter, the signal from scanner 20 causes the band transport to be stopped again, after the band has been transported by a length equal to that of one label.

Figure 2A:
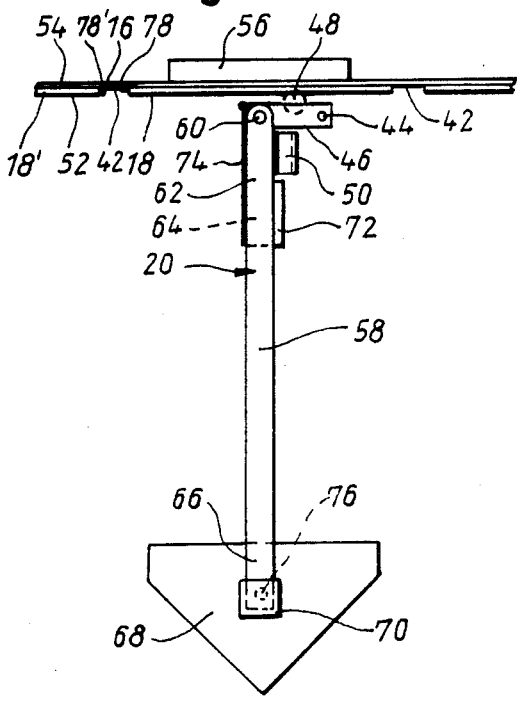

As can be seen from FIGS. 2*a* and *b*, scanning device 20 consists of an angle lever 46 rotatable about an axis 44. A feeler roller 48 is eccentrically mounted on the angle lever, the two being pressed against the label-carrying surface 52 of the conveyer band by a strong leaf spring 50. A supporting plate 56 for the band is provided on the side opposite the roller. In addition, a long flat bar 58 is connected to angle lever 46 for rotation about an axis 60 parallel to axis 44. End 62 of bar 58 extends over perpendicularly extending arm 64 of the angle lever, while its free end 66 rests on a flat table 68 and controls the passage of air through an air barrier 70. The contacting surface in the region of arm 64 is bounded on the one side by a stop 72 and on the opposite side by a flat spring 74 fastened near axis 60.

Figure 2B:
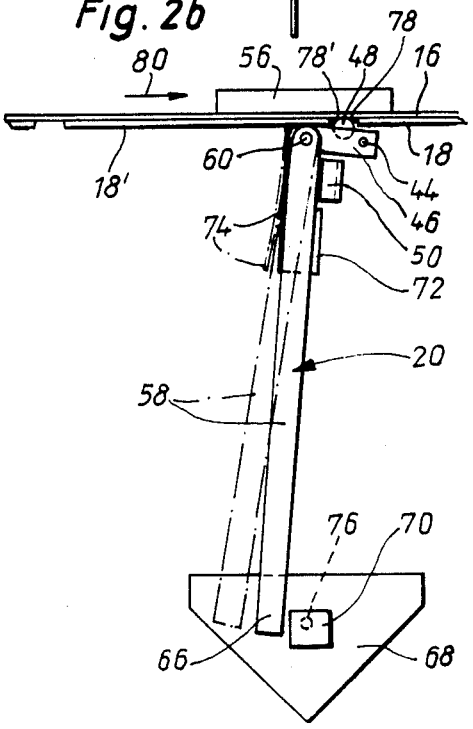

As long as band 16 is stationary, feeler roller 48 is pressed against the surface 52 of a self-adhesive label 18 present in this position. The free end 66 of bar 58 blocks the air passage in air cell 70, i.e. prevents air from reaching a receiving nozzle 76. This condition is maintained while the band is transported in the direction of arrow 80, as long as roller 48 still presses against surface 52 of label 18. However, as soon as the trailing edge 78 of label 18 passes the scanning location, roller 48 is pushed by spring 50 with simultaneous rotation of level 46 into the depression formed by gap 42 between the labels. Immediately thereafter, the roller crosses leading edge 78' of the next following label 18' and is lifted to the surface 52 of the latter. During this pivoting, bar 58 is first carried along by stop 72, so that it already has moved some distance out of the air passage 46 of air cell 70, as illustrated in the solid lines in FIG. 2*b*.

To assure a proper response from air cell 60, the above condition must be maintained for a time period in the order of several milliseconds to ten milliseconds. If the connection between lever 46 and bar 58 were a rigid connection, this could only be accomplished by a relatively slow band transport and/or large gaps 42 between individual labels 18, 18'. To avoid this problem, bar 58 is pivotably mounted on lever 46. Thus when roller 48 enters into the gap between labels, bar 58 is carried along by stop 72 and is accelerated to the angular velocity of lever 46. Because of its inertia, bar 58 continues to rotate in the original direction against the force exerted by weak spring 74, even after the rotation of lever 46 has been stopped as roller 48 enters gap 42 and subsequently reversed when the roller is lifted by subsequent label 18'. Thus the time that air cell 70 is open can be a multiple of the time that roller 48 rests in the gap between two labels. The exact multiple is determined by choice of the spring constant of spring 74. Thus reliable operation of air cell 70 can be achieved even at high band transport speeds and for small gaps 42. At high band transport velocities, however, the delayed response of air cell 70 causes the band transport to be stopped only when the label 18' which follows the sensed gap 42 has already passed partially by roller 48. This creates no problem as long as the exact distance is known.

While the invention has been illustrated in preferred embodiments, it is not to be limited to the structures shown, since many variations thereof will be evident to one skilled in the art and are intended to be encompassed in the present invention as set forth in the following claims.

We claim:

1. In apparatus for transporting a band along a predetermined path, said band having a first and second side and carrying a series of labels separated by gaps from one another on said first side, each of said labels having a leading and a trailing edge in the direction of transport of said band:

scanning means located in operative vicinity of said band at a predetermined location along said predetermined path for generating a scanning output signal when a label is in a predetermined position relative thereto, said scanning means comprising backing means arranged along said second side of said band at said predetermined location;

feeler means positioned opposite said backing means and riding on said first side of said band for moving from a rest to an activating position in response to sensing of a selected one of said edges;

means coupled to said feeler means for generating said scanning output signal when said feeler means moves from said rest to said activating position;

wherein said means for generating said scanning output signal comprises switch means operative in a first and second state and furnishing said scanning output signal when in said first state, and coupling means connected to said feeler means and said switch means for moving said switch means to said first state when said feeler means is in said activating position; and further comprising delay means coupled to said scanning means for maintaining said switch means in said first state for a predetermined time interval following return of said feeler means to said rest position.

2. Apparatus as set forth in claim 1, wherein said feeler means comprises a feeler element and spring means connected to said feeler element for pushing said feeler element against said first side of said band.

3. Apparatus as set forth in claim 2, wherein said feeler element moves from said rest to said activating position when riding across said trailing edges of said labels.

4. Apparatus as set forth in claim 2, wherein said means for generating said scanning output signal comprises switch means operative in a first and second state and furnishing said scanning output signal when in said first state, and coupling means connected to said feeler means and said switch means for moving said switch means to said first state when said feeler means is in said activating position.

5. Apparatus as set forth in claim 4, further comprising a level surface surrounding said switch means; and wherein said coupling means comprises a bar having a second end portion moving over said level surface relative to said switch means when changing said switch means from said first to said second state.

6. Apparatus as set forth claim 1, wherein said switch means comprises a light cell transmitting a light beam from a first to a second cell element when said switch means is in said first state, and wherein said coupling means interrupts said light beam to activate said switch means to said second state.

7. Apparatus as set forth in claim 1, wherein said delay means comprises a spring.

8. Apparatus as set forth in claim 1, wherein said switch means comprises an air cell transmitting an air stream from a first to a second nozzle when said switch means is in said first state; and wherein said coupling means interrupts said air stream when said switch means is in said second state.

9. In apparatus for transporting a band along a predetermined path, said band having a first and second side and carrying a series of labels separated by gaps from one another on said first side, each of said labels having a leading and a trailing edge in the direction of transport of said band:

scanning means located in operative vicinity of said band at a predetermined location along said predetermined path for generating a scanning output signal when a label is in a predetermined position relative thereto, said scanning means comprising backing means arranged along said second side of said band at said predetermined location;

feeler means positioned opposite said backing means and riding on said first side of said band for moving from a rest to an activating position in response to sensing of a selected one of said edges;

means coupled to said feeler means for generating said scanning output signal when said feeler means moves from said rest to said activating position; and delay means coupled to said scanning output signal generating means for maintaining said generating of said scanning output signal for at least a predetermined time interval following return of said feeler means to said rest position.

10. Apparatus as set forth in claim 9, wherein said standing output signal is a stop signal; and further comprising means for stopping said transport of said band upon receipt of said scanning signal.

11. Apparatus as set forth in claim 9, wherein said feeler means further comprises stop means for moving said coupling means in a corresponding direction when said feeler means moves from said rest to said activating position;

wherein said coupling means continues to move in said corresponding direction after stopping of said feeler means, and said delay means comprises means for weakly opposing said movement of said coupling means in said corresponding direction and for returning said coupling means to said stop means following a predetermined delay time.

12. Apparatus as set forth in claim 11, wherein said feeler means further comprises a lever mounted to pivot about a first axis extending parallel to said band in a direction perpendicular to said predetermined path;

wherein said feeler element is arranged eccentrically to said axis and projects past said lever towards said band, and wherein said stop means is located on said lever and said coupling means comprises a bar pivotably mounted for rotation about a second axis parallel to said first axis, said bar having a first end portion abutting said stop means and a second end portion activating said switch means.

13. Apparatus as set forth in claim 12, wherein said lever is an angle lever having a first arm carrying said feeler element and a second arm extending substantially perpendicularly to said first arm and carrying said first end portion of said bar, said second arm further having a side portion extending perpendicularly thereto and constituting said stop means;

wherein said delay means comprises a flat spring connected to said second arm of said lever near said second axis and opposing said motion of said bar in said corresponding direction.

14. Apparatus as set forth in claim 13, wherein said spring means comprises a leaf spring pushing said first arm of said lever towards said first side of said band.

15. In apparatus for transporting a band along a predetermined path, said band having a first and second side and carrying a series of labels separated by gaps from one another on said first side, each of said labels having a leading and a trailing edge in the direction of transport of said band:

scanning means located in operative vicinity of said band at a predetermined location along said predetermined path for generating a scanning output signal when a label is in a predetermined position relative thereto, said scanning means comprising means scanning said first side of said band and generating said scanning output signal in response to sensing of a selected one of said edges; and delay means coupled to said sensing means for maintaining said generating of said scanning output signal for a predetermined time interval following sensing of said selected one of said edges.

16. Apparatus as set forth in claim 15, wherein said sensing means comprises feeler means riding on said first side of said band and moving from a rest to an activating position in response to said sensing of said selected one of said edges, and means coupled to said feeler means for generating said scanning output signal when said feeler means moves from said rest to said activating position.

* * * * *